US008992645B2

(12) United States Patent
Upadhyay et al.

(10) Patent No.: US 8,992,645 B2
(45) Date of Patent: Mar. 31, 2015

(54) ABRASIVE ARTICLE FOR USE IN GRINDING OF SUPERABRASIVE WORKPIECES

(75) Inventors: Rachana Upadhyay, Shrewsbury, MA (US); Srinivasan Ramanath, Holden, MA (US); Christopher Arcona, Northborough, MA (US); John E. Gillespie, Dudley, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 13/210,815

(22) Filed: Aug. 16, 2011

(65) Prior Publication Data

US 2012/0036789 A1 Feb. 16, 2012

Related U.S. Application Data

(60) Provisional application No. 61/374,174, filed on Aug. 16, 2010.

(51) Int. Cl.

| | |
|---|---|
| ***B24D 18/00*** | (2006.01) |
| ***B24D 3/06*** | (2006.01) |
| ***B24D 3/20*** | (2006.01) |
| ***B24D 5/02*** | (2006.01) |
| ***B24D 3/28*** | (2006.01) |

(52) U.S. Cl.

CPC .. *B24D 5/02* (2013.01); *B24D 3/06* (2013.01); *B24D 3/28* (2013.01); *B24D 18/0009* (2013.01)

USPC ..... 51/298; 51/293; 51/307

(58) Field of Classification Search

USPC ..... 51/298; 451/41

See application file for complete search history.

(56) References Cited

U.S. PATENT DOCUMENTS

| | | | | | |
|---|---|---|---|---|---|
| 3,645,706 | A | * | 2/1972 | Bovenkerk et al. | 51/295 |
| 3,779,727 | A | * | 12/1973 | Siqui et al. | 51/298 |
| 3,899,307 | A | * | 8/1975 | Thompson | 51/298 |
| 3,929,432 | A | | 12/1975 | Caveney | |
| 3,957,461 | A | * | 5/1976 | Lindstrom et al. | 51/295 |
| 3,984,214 | A | * | 10/1976 | Pratt et al. | 51/298 |
| 4,399,167 | A | | 8/1983 | Pipkin | |

(Continued)

FOREIGN PATENT DOCUMENTS

| | | | |
|---|---|---|---|
| JP | 2001252874 | A | 9/2001 |
| JP | 2002-066928 | A | 3/2002 |

(Continued)

OTHER PUBLICATIONS

International Search Report from PCT/US2012/045124 mailed Dec. 10, 2012.

(Continued)

*Primary Examiner* — Pegah Parvini

(74) *Attorney, Agent, or Firm* — Abel Law Group, LLP; Joseph P. Sullivan

(57) ABSTRACT

An abrasive article including a bonded abrasive having a body formed of abrasive grains contained within a bond material, wherein the body grinds a superabrasive workpiece having an average Vickers hardness of at least about 5 GPa at an average specific grinding energy (SGE) of not greater than about 350 J/mm$^3$, at a material removal rate of at least about 8 mm$^3$/sec, and wherein grinding is a centerless grinding operation.

20 Claims, 3 Drawing Sheets

(56) References Cited

U.S. PATENT DOCUMENTS

| | | | | |
|---|---|---|---|---|
| 4,475,926 | A * | 10/1984 | Hickory | 51/298 |
| 4,671,021 | A | 6/1987 | Takahashi et al. | |
| 4,712,332 | A | 12/1987 | Smith | |
| 5,063,714 | A * | 11/1991 | Meyer | 451/541 |
| 5,096,465 | A | 3/1992 | Chen et al. | |
| 5,104,422 | A | 4/1992 | St. Pierre | |
| 5,658,194 | A | 8/1997 | Micheletti | |
| 6,019,668 | A * | 2/2000 | Ramanath et al. | 451/41 |
| 6,063,148 | A | 5/2000 | Fischbacher | |
| 6,093,092 | A | 7/2000 | Ramanath et al. | |
| 6,099,605 | A | 8/2000 | Cook et al. | |
| 6,102,789 | A | 8/2000 | Ramanath et al. | |
| 6,258,139 | B1 | 7/2001 | Jensen | |
| 6,596,225 | B1 | 7/2003 | Pope et al. | |
| 6,685,755 | B2 | 2/2004 | Ramanath et al. | |
| 6,755,729 | B2 | 6/2004 | Ramanath et al. | |
| 7,507,267 | B2 | 3/2009 | Hall et al. | |
| 7,658,665 | B2 | 2/2010 | Subramanian et al. | |
| 7,677,954 | B2 | 3/2010 | Hall et al. | |
| 7,828,627 | B2 | 11/2010 | Hall et al. | |
| 2003/0050000 | A1 | 3/2003 | Nonogawa et al. | |
| 2003/0091826 | A1 | 5/2003 | Abe et al. | |
| 2003/0194947 | A1 | 10/2003 | Bright et al. | |
| 2003/0232586 | A1 | 12/2003 | Ramanath et al. | |
| 2005/0026553 | A1 | 2/2005 | Bonner et al. | |
| 2005/0076577 | A1 | 4/2005 | Hall et al. | |
| 2005/0121417 | A1 | 6/2005 | Dixon et al. | |
| 2005/0272349 | A1 | 12/2005 | Burgess | |
| 2006/0102389 | A1 | 5/2006 | Wiseman et al. | |
| 2007/0037492 | A1 | 2/2007 | Hood et al. | |
| 2007/0216071 | A1 | 9/2007 | Peterman, Jr. et al. | |
| 2007/0275641 | A1 | 11/2007 | Subramanian et al. | |
| 2008/0293328 | A1 | 11/2008 | Hall et al. | |
| 2009/0093198 | A1 | 4/2009 | Subramanian et al. | |
| 2009/0151267 | A1 * | 6/2009 | Upadhyay et al. | 51/298 |
| 2009/0152018 | A1 | 6/2009 | Sani | |
| 2010/0159806 | A1 | 6/2010 | Wu et al. | |
| 2011/0252710 | A1 | 10/2011 | Hall et al. | |
| 2012/0036789 | A1 | 2/2012 | Upadhyay et al. | |
| 2012/0055098 | A1 | 3/2012 | Ramanath et al. | |
| 2012/0066982 | A1 | 3/2012 | Ramanath et al. | |
| 2013/0000211 | A1 | 1/2013 | Upadhyay et al. | |

FOREIGN PATENT DOCUMENTS

| | | | |
|---|---|---|---|
| JP | 4159262 | B | 10/2008 |
| WO | 97/37815 | A1 | 10/1997 |
| WO | 99/48646 | A1 | 9/1999 |
| WO | 2011/072298 | A2 | 6/2011 |
| WO | 2012/024267 | A2 | 2/2012 |
| WO | 2012/024277 | A2 | 2/2012 |
| WO | 2012/145284 | A2 | 10/2012 |
| WO | 2013/003817 | A1 | 1/2013 |

OTHER PUBLICATIONS

International Search Report from PCT/US2011/047870 mailed Feb. 22, 2012.

International Search Report from PCT/US2011/047887 mailed Mar. 8, 2012.

Boedeker Plastics, Inc., "Celazole PBI PolyBenzlmidazole Datasheet", Copyright Boedeker Plastics, Inc., 2014, 3 pages.

* cited by examiner

ABRASIVE ARTICLE FOR USE IN GRINDING OF SUPERABRASIVE WORKPIECES

CROSS-REFERENCE TO RELATED APPLICATION(S)

The present application claims priority from U.S. Provisional Patent Application No. 61/374,174, filed Aug. 16, 2010, entitled "ABRASIVE ARTICLE FOR USE IN GRINDING OF SUPERABRASIVE WORKPIECES", naming inventors Rachana Upadhyay, Srinivasan Ramanath, Christopher Arcona, and John E. Gillespie, which application is incorporated by reference herein in its entirety.

BACKGROUND

1. Field of the Disclosure

The following is directed to abrasive articles, and more particularly, bonded abrasive articles suitable for grinding superabrasive workpieces.

2. Description of the Related Art

Abrasives used in machining applications typically include bonded abrasive articles and coated abrasive articles. Coated abrasive articles generally include a layered article including a backing and an adhesive coat to fix abrasive grains to the backing, the most common example of which is sandpaper. Bonded abrasive tools consist of rigid, and typically monolithic, three-dimensional, abrasive composites in the form of wheels, discs, segments, mounted points, hones and other tool shapes, which can be mounted onto a machining apparatus, such as a grinding or polishing apparatus.

Bonded abrasive tools usually have three phases including abrasive grains, bond material, and porosity, and can be manufactured in a variety of 'grades' and 'structures' that have been defined according to practice in the art by the relative hardness and density of the abrasive composite (grade) and by the volume percentage of abrasive grain, bond, and porosity within the composite (structure).

Some bonded abrasive tools may be particularly useful in grinding and polishing hard materials, such as single crystal materials used in electronics and optics industries as well as superabrasive materials for use in industrial applications, such as earth boring. For example, polycrystalline diamond compact (PDC) cutting elements are typically affixed to the head of drill bits for earth boring applications in the oil and gas industry. The PDC cutting elements include a layer of superabrasive material (e.g., diamond), which must be ground to particular specifications. One method of shaping the PDC cutting elements is use of bonded abrasive tools, which typically incorporate abrasive grains contained within an organic bond matrix.

The industry continues to demand improved methods and articles capable of grinding superabrasive workpieces.

SUMMARY

According to one aspect, an abrasive article includes a bonded abrasive having a body including abrasive grains contained within a bond material, wherein the body grinds a superabrasive workpiece having an average Vickers hardness of at least about 5 GPa at an average specific grinding energy (SGE) of not greater than about 350 J/mm$^3$ at an average material removal (MRR) rate of at least about 8 mm$^3$/sec for a centerless grinding operation.

According to another aspect, an abrasive article includes a bonded abrasive having a body including abrasive grains contained within a composite bond material comprising an organic material and a metal material, wherein the composite bond material has a fracture toughness of not greater than about 3.0 MPa m$^{0.5}$.

In yet another aspect, an abrasive article includes a bonded abrasive having a body including abrasive grains contained within a composite bond material comprising an organic material and a metal material, wherein the bond material comprise a ratio (OM/MM) of organic material by volume (OM) to metal material by volume (MM) of not greater than about 0.25.

In still another aspect, an abrasive article includes a bonded abrasive having a body configured to grind workpieces comprising superabrasive material, wherein the body has abrasive grains contained within a composite bond material comprising an organic material and a metal material, wherein not less than about 82% of the abrasive grains by volume are contained within the metal material of the composite bond material.

According to one aspect, a bonded abrasive having a body includes abrasive grains contained within a composite bond material, wherein the composite bond material has a fracture toughness of not greater than about 3.0 MPa m0.5 and the body comprises a threshold power for grinding of not greater than about 150 W/mm for an average material removal rate (MRR) of at least about 8 mm$^3$/sec during centerless grinding of a superabrasive workpiece having an average Vickers hardness of at least about 5 GPa.

In another aspect, a method of forming an abrasive article includes forming a mixture including organic material, metal material, and abrasive grains, and treating the mixture to form an abrasive article having a body including abrasive grains contained within a composite bond material comprising an organic material and a metal material, wherein the bond material comprise a ratio (OM/MM) of organic material by volume (OM) to metal material by volume (MM) of not greater than about 0.25.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
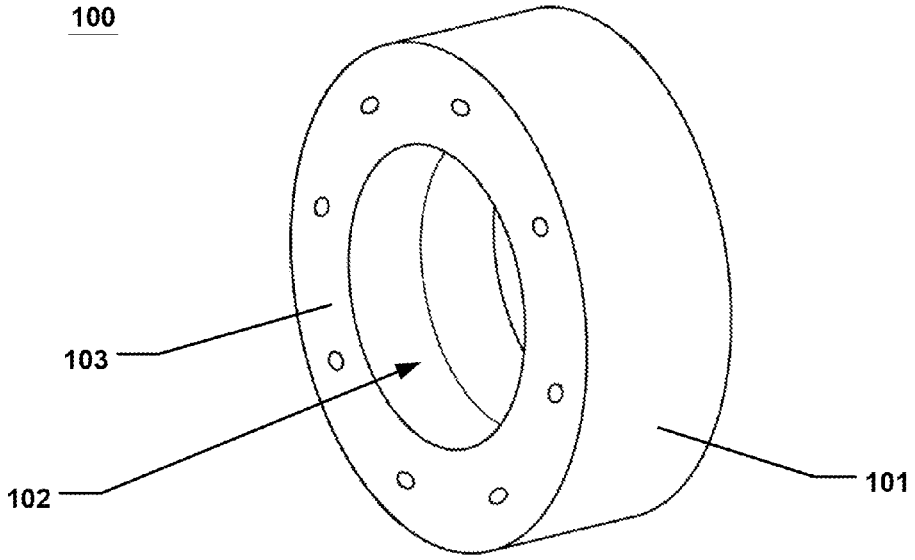
FIG. 1 includes an illustration of an abrasive article in accordance with an embodiment.

The following is generally directed to abrasive articles and methods of using such abrasive articles for particular grinding operations. In particular reference to the process of forming the bonded abrasive article, initially, abrasive grains can be combined with a bond material. According to one embodiment, the bond material can be a composite bond material, having components of organic material and metal material mixed together. However, the abrasive grains may first be mixed with one of the components of the bond material. For example, the abrasive grains can be mixed with the organic material.

The abrasive grains can include materials such as oxides, carbides, borides, and nitrides and a combination thereof. In particular instances, the abrasive grains can include superabrasive materials such as diamond, cubic boron nitride, and a combination thereof. Certain embodiments may utilize abrasive grains that consist essentially of diamond.

In further reference to the abrasive grains, the abrasive grains can have an average grit size of less than 250 microns. In other instances the abrasive grains can have an average grit size of less than 200 microns, such as less than 170 microns. Certain abrasive articles may utilize abrasive grains having an average grit size within a range between 1 micron and about 250 microns, such as between 50 microns and about 250 microns, and more particularly between about 100 microns and about 200 microns.

The mixture may utilize more than one type of abrasive grain. Moreover, the mixture may use abrasive grains having more than one average grit size. That is, for example, a mixture of abrasive grains can be used that includes large and small grit sizes. In one embodiment, a first portion of abrasive grains having, for example, a large average grit size, can be combined with a second portion of abrasive grains having, for example, a smaller average grit size than the large abrasive grains of the first portion. The first and second portions may be equal parts (e.g., weight percent) within the mixture. In other embodiments, one may utilize a mixture having a greater or lesser percentage of large and small grains as compared to each other.

A bonded abrasive article can be formed that includes a first portion of abrasive grains having an average grit size of less than about 150 microns, in combination abrasive grains having an average grit size that is greater than 150 microns. In one particular instance the mixture can include a first portion of abrasive grains having an average grit size within a range between 100 microns and 150 microns and a second portion of abrasive grains having an average grit size within a range between 150 microns and 200 microns.

The mixture can contain a certain content of abrasive grains such that the finally-formed bonded abrasive body includes at least about 5 vol % abrasive grains for the total volume of the body. It will be appreciated that for other exemplary abrasive articles, the content of abrasive grains within the body can be greater, such as at least about 10 vol %, at least about 20 vol %, at least about 30 vol % or even at least about 40 vol % of the total volume of the body. In some abrasive articles, the mixture can contain an amount of abrasive grains such that the finally-formed body contains between about 5 vol % and about 60 vol %, and more particularly, between about 5 vol % and 50 vol % abrasive grains for the total volume of the body.

In reference to the organic material component of the bond material, some suitable organic materials include thermosets and thermoplastics. In particular, the bond material can include materials such as polyimides, polyamides, resins, aramids, epoxies, polyesters, polyurethanes, and a combination thereof. In accordance with a particular embodiment, the organic material can include a polyarenazole. In a more particular embodiment, the organic material can include polybenzimidazole (PBI). Additionally, the bond material may include some content of resin material, such as phenolic resin. In such embodiments utilizing a resin, the resin can be present in minor amounts, and may be used in combination with other organic materials.

The mixture can contain a certain content of organic material such that the finally-formed bonded abrasive body includes not greater than about 20 vol % of organic material for the total volume of the bond material. In other embodiments, the amount of organic material within the bond material may be less, for example, not greater than about 18 vol %, not greater than about 16 vol %, not greater than about 14 vol %, or even not greater than about 10 vol %. In particular instances, the body can be formed such the organic material is present in an amount within a range between about 1 vol % and about 20 vol %, such as between about 1 vol % and about 19 vol %, and more particularly within a range between about 2 vol % and 12 vol %.

After forming a mixture of organic material and abrasive grains, a metal material may be added to facilitate the formation a composite bond material, wherein the composite bond material contains the organic material and metal material. In certain instances, the metal material can include metals or metal alloys. The metal material may incorporate one or more transition metal elements. In accordance with one embodiment, the metal material can include copper, tin, and a combination thereof. In fact, embodiments herein may utilize a metal material that consists essentially of bronze, and contains a ratio of copper:tin ratio of approximately 60:40 by weight.

A certain content of metal material may be added to the mixture, such that the finally-formed bonded abrasive body contains at least about 20 vol % metal material for the total volume of the bond material. In other instances, the amount of metal material within the composite bond material can be greater, such as on the order of at least about 30 vol %, at least about 40 vol %, at least about 50 vol %, or even at least about 60 vol %. Particular embodiments may utilize an amount of metal material within a range between about 20 vol % and about 99 vol %, such as between about 30 vol % and about 95 vol %, or even between about 50 vol % and about 95 vol % for the total volume of the composite bond material.

After forming the mixture containing the abrasive grains, organic material, and metal material, the mixture can be agitated or mixed for a sufficient duration to ensure uniform distribution of the components within each other. After ensuring the mixture is suitably mixed, the process of forming the abrasive article can continue by treating the mixture.

In accordance with one embodiment, treating the mixture can include a pressing process. More particularly, the pressing process can include a hot pressing process, wherein the mixture is heated and pressed simultaneously to give the mixture a suitable shape. The hot pressing operation can utilize a mold, wherein the mixture is placed in the mold, and during the hot pressing operation, the application of heat and pressure is utilized to form the mixture to the contours of the mold and give the mixture a suitable, finally-formed shape.

In accordance with one embodiment, the hot pressing operation can be conducted at a pressing temperature of not greater than about 600° C. The pressing temperature is considered the maximum soaking temperature utilized during hot pressing to facilitate proper formation of the bond material. In accordance with another embodiment, hot pressing process can be conducted at a pressing temperature of not greater than about 550° C., such as not greater than 500° C. In particular instances, hot pressing can be completed at a pressing temperature with a range between about 400° C. and 600° C. and more particularly within a range between about 400° C. and 490° C.

The pressing process can be conducted at a particular pressure that is a maximum and sustained pressure exerted upon the mixture suitable to form the mixture to the desired shape.

For example, the hot pressing process can be conducted at a maximum pressing pressure of not greater than about 10 tons/in$^2$. In other embodiments, the maximum pressing pressure may be less, such as not greater than about 8 tons/in$^2$, not greater than about 6 tons/in$^2$. Still, certain hot pressing processes can utilize a pressing pressure within a range between about 0.5 tons/in$^2$ and about 10 tons/in$^2$, such as within a range between 0.5 tons/in$^2$ and 6 tons/in$^2$.

In accordance with an embodiment, the pressing process can be conducted such that the pressing pressure and pressing temperature are held for a duration of at least about 5 minutes. In other embodiments, the duration may be greater, such as at least about 10 minutes, at least about 20 minutes, or even at least 30 minutes.

Generally, the atmosphere utilized during the treating operation can be an inert atmosphere, comprising an inert species (e.g., noble gas), or a reducing atmosphere having a limited amount of oxygen. In other instances, the pressing operation can be conducted in an ambient atmosphere.

Upon completion of the hot pressing operation, the resulting form can be an abrasive article comprising abrasive grains contained within a composite bond material.

FIG. 1 includes an abrasive article in accordance with an embodiment. As illustrated, the abrasive article 100 can include a bonded abrasive body 101 having a generally annular shape and defining a central opening 102 extending axially through the body 101. The bonded abrasive body 101 can include abrasive grains contained within the composite bond material as described herein. In accordance with an embodiment, the abrasive article 100 can be an abrasive wheel having a central opening 102, which aids coupling of the bonded abrasive body to suitable grinding machinery, which is designed to rotate the abrasive article for material removal operations. Moreover, the insert 103 can be placed around the body 101 and define the central opening 102 and in particular instances, the insert 103 may be a metal material which can facilitated coupling of the body 101 to machinery.

The bonded abrasive body 101 can define an abrasive rim extending circumferentially around an edge of the abrasive article 100. That is, the body 101 can extend along the outer peripheral edge of the insert 103, which is affixed (e.g., using fasteners, adhesives, and a combination thereof) to the body 101.

The body 101 can have particular amounts of abrasive grain, bond material, and porosity. The body 101 can include the same amount (vol %) of abrasive grains as described herein. The body 101 can include at least 10 vol % composite bond material for the total volume of the body. In other instances, the body 101 can include a greater content of composite bond material, such as at least 20 vol %, at least about 30 vol %, at least about 40 vol %, or even at least about 50 vol % for the total volume of the body 101. In other instances, the body 101 can be formed such that the composite bond material comprises between about 10 vol % and about 80 vol %, such as between about 10 vol % and 60 vol %, or even between about 20 vol % and about 60 vol % bond material for the total volume of the body 101.

Notably, the body 101 can be formed to have a particular ratio based on the volume percent of the organic materials (OM) to metal materials (MM) contained within the composite bond material. For example, the composite bond material can have a ratio (OM/MM) of organic material by volume (OM) to metal material by volume (MM) having a value of not greater than about 0.25. In accordance with other embodiments, the abrasive article can be formed such that the composite bond material ratio is not great than about 0.23, such as not greater than about 0.20, not greater than about 0.18, not greater than about 0.15, or even not greater than about 0.12. In particular instances, the body can be formed such that the composite bond material has a ratio of organic material to metal material (OM/MM) within a range between about 0.02 and 0.25, such as between about 0.05 and 0.20, between about 0.05 and about 0.18, between about 0.05 and about 0.15, or even between about 0.05 and about 0.12.

The abrasive article may be formed such that the body 101 contains a certain content of porosity. For example, the body 101 can have a porosity of not greater than about 10 vol % for the total volume of the body 101. In other instances, the body 101 can have a porosity of not greater than about 8 vol %, such as not greater than about 5 vol %, or even not greater than about 3 vol %. Still, the body, 101 can be formed such that the porosity is within a range between 0.5 vol % and 10 vol %, such as between 0.5 vol % and about 8 vol %, between about 0.5 vol % and 5 vol %, or even between about 0.5 vol % and 3 vol w% of the total volume of the body 101. The majority of the porosity can be closed porosity comprising closed and isolated pores within the bond material. In fact, in certain instances, essentially all of the porosity within the body 101 can be closed porosity.

In addition to the features described herein, the body 101 can be formed such that it has a composite bond material wherein not less than about 82% of the abrasive grains within the body 101 are contained within the metal material of the composite bond material. For example, the body 101 can be formed such that not less than 85%, such as not less than about 87%, not less than about 90%, or even not less than about 92% of the abrasive grains within the body 101 are contained within the metal material of the composite bond material. The body 101 can be formed such that between about 82% to about 97%, and more particularly, between 85% and about 95% of the abrasive grains within the body 101 can be contained within the metal material of the bond material.

The bonded abrasive article of the embodiments can utilize a composite bond having a fracture toughness of not greater than 3.0 MPa m$^{0.5}$. In fact, certain bonded abrasive articles can have a bond material having a fracture toughness that is not greater than about 2.5 MPa m$^{0.5}$, such as not greater than about 2.0 MPa m$^{0.5}$, or even not greater than about 1.8 MPa m$^{0.5}$. Certain bonded abrasive articles can utilize a composite bond material having a fracture toughness between about 1.5 MPa m$^{0.5}$ and about 3.0 MPa m$^{0.5}$ such as within a range between about 1.5 MPa m$^{0.5}$ and 2.5 MPa m$^{0.5}$ and even within a range between about 1.5 MPa m$^{0.5}$ and about 2.3 MPa m$^{0.5}$.

The abrasive articles herein may be particularly suitable for removing material from particular workpieces, such as by a grinding process. In particular embodiments, the bonded abrasive articles of embodiments herein can be particularly suitable for grinding and finishing of workpieces incorporating super hard materials or superabrasive materials. That is, the workpieces can have an average Vicker's hardness of 5 GPa or greater. In fact, certain workpieces, which may be finished by the bonded abrasive articles of the embodiments herein, can have an average Vicker's hardness of at least about 10 GPa, such as at least about 15 GPa, or even at least about 25 GPa.

In fact, in certain instances, the bonded abrasive articles herein are particularly suitable for grinding of materials, which are also used in abrasive applications. One particular example of such workpieces includes polycrystalline diamond compact (PDC) cutting elements, which may be placed on the heads of earthboring drill bits used in the oil and gas industry. Generally, PDC cutting elements can include a composite material having an abrasive layer overlying a substrate.

The substrate can be a cermet (ceramic/metallic) material. That is, the substrate can include some content of metal, typically an alloy or superalloy material. For example, the substrate can have a metal material that has a Mohs hardness of at about 8. The substrate can include a metal element, which can include one or more transition metal elements. In more particular instances, the substrate can include a carbide material, and more particularly tungsten carbide, such that the substrate can consist essentially of tungsten carbide.

The workpieces that may be ground by the bonded abrasive articles herein may include cutting elements. Furthermore, certain workpieces can be particularly brittle materials, having a fracture toughness of at least about 4.0 MPa $m^{0.5}$. In fact, the workpiece can have a fracture toughness of at least about 5.0 MPa $m^{0.5}$, such as at least about 6.0 MPa $m^{0.5}$, or even at least about 8.0 MPa $m^{0.5}$. Further, in certain instances, the workpiece can have a fracture toughness that is not greater than about 16.0 MPa $m^{0.5}$, such as not greater than 15.0 MPa $m^{0.5}$, 12.0 MPa $m^{0.5}$, or 10.0 MPa $m^{0.5}$. Certain workpieces can utilize a material having a fracture toughness within a range including about 4.0 MPa $m^{0.5}$ to about 16.0 MPa $m^{0.5}$, such as within a range including about 4.0 MPa $m^{0.5}$ to 12.0 MPa $m^{0.5}$ and even within a range including about 4.0 MPa $m^{0.5}$ to about 10.0 MPa $m^{0.5}$.

The abrasive layer of the workpiece may be bonded directly to the surface of the substrate. The abrasive layer can include hard materials such as carbon, fullerenes, carbides, borides, and a combination thereof. In one particular instance, the abrasive layer can include diamond, and more particularly may be a polycrystalline diamond layer. Some workpieces, and particularly PDC cutting elements, can have an abrasive layer consisting essentially of diamond. In accordance with at least one embodiment, the abrasive layer can be formed of a material having a Mohs hardness of at least about 9. Moreover, the workpiece may have a generally cylindrically shaped body, particularly in reference to PDC cutting elements.

It has been found that the bonded abrasive articles of embodiments herein are particularly suitable for grinding and/or finishing of workpieces incorporating super-hard materials (e.g., metal and metal alloys such as nickel-based superalloys and titanium-based super alloys, carbides, nitride, borides, fullerenes, diamond, and a combination thereof). During a material removal (i.e., grinding) operation, the bonded abrasive body can be rotated relative to the workpiece to facilitate material removal from the workpiece.

Figure 2:
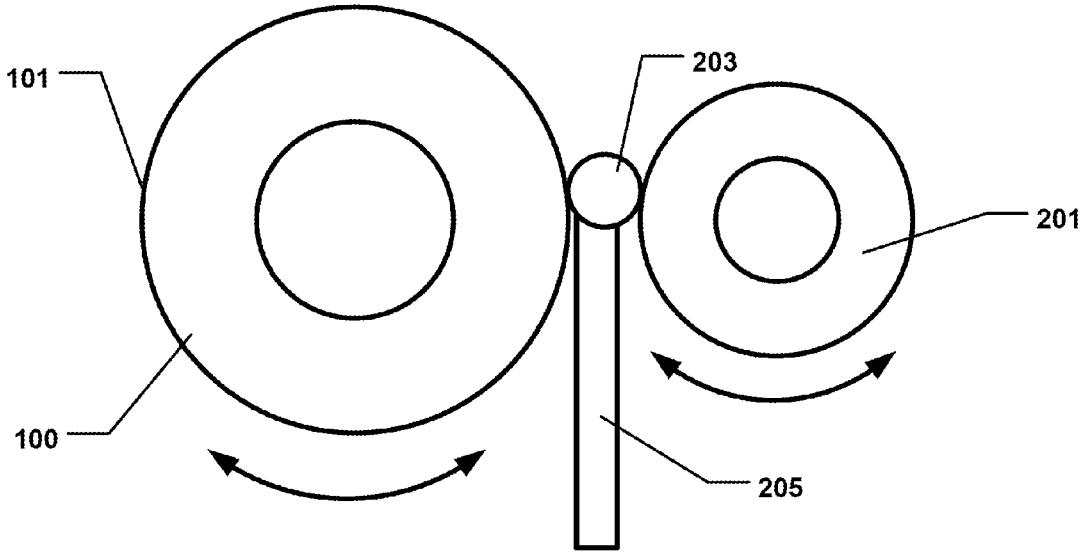
FIG. 2 includes a diagram of a grinding operation in accordance with an embodiment.

One such material removal process is illustrated in FIG. 2. FIG. 2 includes a diagram of a grinding operation in accordance with an embodiment. In particular, FIG. 2 illustrates a centerless grinding operation utilizing the abrasive article 100 in the form of an abrasive wheel incorporating the bonded abrasive body 101. The centerless grinding operation can further include a regulating wheel 201, which can be rotated at a particular speed to control the grinding process. As further illustrated, for a particular centerless grinding operation, a workpiece 203 can be disposed between the abrasive wheel 100 and the regulating wheel 201. The workpiece 203 can be supported in a particular position between the abrasive wheel 100 and the regulating wheel 201 by a support 205, configured to maintain the position of the workpiece 203 during grinding.

According to one embodiment, during centerless grinding, the abrasive wheel 100 can be rotated relative to the workpiece 203, wherein the rotation of the abrasive wheel 100 facilitates movement of the bonded abrasive body 101 relative a particular surface (e.g., a circumferential side surface of the cylindrical workpiece) of the workpiece 203, and thus, grinding of the surface of the workpiece 203. Additionally, the regulating wheel 201 can be rotated at the same time the abrasive wheel 100 is rotated to control the rotation of the workpiece 203 and control certain parameters of the grinding operation. In certain instances, the regulating wheel 201 can be rotated in the same direction as the abrasive wheel 100. In other grinding processes, the regulating wheel 201 and the abrasive wheel 100 can be rotated in opposite directions relative to each other.

It has been noted that by utilizing the bonded abrasive bodies of the embodiments herein, the material removal processes can be conducted in a particularly efficient manner as compared to prior art products and processes. For example, the bonded abrasive body can conduct grinding of a workpiece comprising a superabrasive material at an average specific grinding energy (SGE) of not greater than about 350 J/$mm^3$. In other embodiments, the SGE can be less, such as not greater than about 325 J/$mm^3$, such as greater than about 310 J/$mm^3$, not greater than about 300 J/$mm^3$, or even not greater than 290 J/$mm^3$ Still, for certain grinding operations, the bonded abrasive material can remove material from the workpiece at an average SGE within a range between about 50 J/$mm^3$ and about 350 J/$mm^3$, such as between about 75 J/$mm^3$ and about 325 J/$mm^3$, or even within a range of between about 75 J/$mm^3$ and about 300 J/$mm^3$ It should be noted that certain grinding parameters (e.g., specific grinding energy) can be achieved in combination with other parameters, including for example, particular material removal rates (MRR). For example, the average material removal rate can be at least about 8 $mm^3$/sec. In fact, greater material removal rates have been achieved, such as on the order of at least about 10 $mm^3$/sec, such as at least about 12 $mm^3$/sec, at least about 14 $mm^3$/sec, at least about 16 $mm^3$/sec, or even at least about 18 $mm^3$/sec. In accordance with particular embodiments, grinding operations utilizing the bonded abrasive bodies herein can achieve average material removal rates within a range between about 8 $mm^3$/sec and about 40 $mm^3$/sec, such as between about 14 $mm^3$/sec and about 40 $mm^3$/sec, such as between about 18 $mm^3$/sec and about 40 $mm^3$/sec, and even between about 20 $mm^3$/sec and 40 $mm^3$/sec.

The grinding operation utilizing the bonded abrasive articles of embodiments herein and a workpiece comprising superabrasive material can be conducted at a threshold power that is not greater than about 150 W/mm Notably, the threshold power is normalized for the contact width of the abrasive article. In other embodiments, the threshold power during the grinding operation can be less, such as not greater than about 140 W/mm, not greater than about 130 W/mm, not greater than about 110 W/mm kW, not greater than about 100 W/mm, not greater than about 90 W/mm, or even not greater than about 75 W/mm. Certain grinding operations can be conducted at a threshold power within a range between about 20 W/mm and about 150 W/mm, such as between about 20 W/mm and about 130 W/mm, such as between about 20 W/mm and 110 W/mm, or even between 20 W/mm and 90 W/mm.

Certain grinding properties (e.g., specific grinding energy, threshold power, material removal rates etc.) can be achieved in combination with particular aspects of the bonded abrasive and grinding process, including for example, particular wheel geometries. For example, the grinding properties herein can be achieved on abrasive articles in the shape of abrasive wheels (see, FIG. 1), wherein the wheels have a diameter of at least about 5 inches, at least about 7 inches, at least about 10 inches, or even at least about 20 inches. In certain instances, the abrasive wheel can have an outer diameter within a range between about 5 inches and about 40 inches, such as between about 7 inches and about 30 inches.

The grinding properties herein can be achieved on abrasive articles in the shape of abrasive wheels (see, FIG. 1), wherein the wheels can have a width, as measured across the width of the abrasive layer defining the rim of the wheel, of at least about 0.5 inches, at least about 1 inch, at least about 1.5 inches, at least about 2 inches, at least about 4 inches, or even at least about 5 inches. Particular embodiments can utilize an abrasive wheel having a width within a range between about 0.5 inches and about 5 inches, such as between about 0.5 inches and about 4 inches, or even between about 1 inch and about 2 inches.

In particular instances, the material removal operations include a centerless grinding operation wherein the speed of the abrasive wheel is at least about 900 m/min, such as on the order of at least about 1000 m/min, at least about 1200 m/min, or even at least about 1500 m/min Particular processes can utilize a grinding wheel speed within a range between about 1000 m/min and about 3000 m/min, such as between about 1200 m/min and about 2800 m/min, or even between about 1500 m/min and about 2500 m/min.

In particular instances, the material removal operations include a centerless grinding operation wherein the speed of the regulating wheel is at least about 5 m/min, such as on the order of at least about 10 m/min, at least about 12 m/min, or even at least about 20 m/min Particular processes can utilize a regulating wheel speed within a range between about 5 m/min and about 50 m/min, such as between about 10 m/min and about 40 m/min, or even between about 20 m/min and about 30 m/min.

The grinding process may also utilize a particular through infeed rate per grinding operation, which is a measure of the radial depth of engagement between the abrasive article and the workpiece. In particular instances, the infeed rate per grind can be at least about 0.01 mm, at least about 0.02 mm, and even at least about 0.03 mm Still, the grinding operation is typically set up such that the infeed rate per grind is within a range between about 0.01 mm and about 0.5 mm, or even between about 0.02 mm and about 0.2 mm. Additionally, the grinding process can be completed such that the through-feed rate of the workpieces is between about 20 cm/min and about 150 cm/min, and more particularly between about 50 cm/min and about 130 cm/min.

It will further be appreciated that in certain centerless grinding operations, the regulating wheel can be angled relative to workpiece and the abrasive wheel to facilitate through-feed of the workpieces. In particular instances, the regulating wheel angle is not greater than about 10 degrees, such as not greater than about 8 degrees, not greater than about 6 degrees, and even not greater than about 4 degrees. For certain centerless grinding operations, the regulating wheel can be angled relative to the workpiece and the abrasive wheel within a range between about 0.2 degrees and about 10 degree, such as between about 0.5 degrees and about 5 degrees, and more particularly within a range between about 1 degree and about 3 degrees.

EXAMPLE

The following includes a comparative example of a bonded abrasive body (S1) formed according to an embodiment herein compared to a conventional abrasive material (C1) designed to grind superabrasive materials.

Sample S1 is formed by combining a mixture of large and small diamond grains, wherein the small diamond grains have an average size of U.S. mesh 100/120 (i.e., average grit size of 125-150 microns) and large diamond grains having a U.S. mesh size of 80/100 (i.e., average grit size of 150-175 microns). The large and small mixture of diamond grains are mixed in equal parts.

The mixture of large and small diamonds is mixed with approximately 25 grams of an organic bond material consisting of polybenzimidazole (PBI) commercially available from Boedeker Plastics Inc. Thereafter, approximately 1520 grams of metal bond is added to the mixture. The metal bond material is a bronze (60/40 of Sn/Cu) composition available as DA410 from Connecticut Engineering Associates Corporation.

The mixture is thoroughly mixed and poured into a mold. The mixture is then hot pressed according to the following procedures. Initially, a line pressure of 60 psi is applied to the mixture. The mixture is then heated to 395° C. A full pressure of 10 tons/in$^2$ is then applied and the mixture is heated to 450° C. for 20 minutes, followed by a cool down.

The finally-formed bonded abrasive article is formed into the shape of an abrasive wheel having an outer diameter of 8 inches and a wheel width of approximately 1 inch. The bonded abrasive article has approximately 62 vol % composite bond material, wherein 90% of the bond material is the metal bond material and 10% of the bond material is the organic material. The bonded abrasive article of sample S1 has approximately 38 vol % abrasive grains. The bonded abrasive article includes a minor amount of porosity, generally, less than 1 vol %.

The conventional sample (C1) is formed by combining a mixture of large and small diamond grains, wherein the small diamond grains have an average grit of U.S. mesh 140/170 (i.e., 150 microns) and the large diamond grains have an average grit size of U.S. mesh 170/200 (i.e., 181 microns). The large and small mixture of diamond grains are mixed in equal parts.

The mixture of large and small diamonds is mixed with an organic bond material consisting of resin and lime, commonly available as DA69 from Saint-Gobain Abrasives. An amount of SiC grains are also added to the mixture, wherein the SiC grains have an average grit size of 800 U.S. mesh and are available as DA49 800 Grit from Saint-Gobain Abrasives Corporation. Additionally, a minor amount (i.e., 3-4 vol %) of furfural is added to the mixture as DA148, available from Rogers Corporation, New Jersey, USA.

The mixture is thoroughly mixed and poured into a mold. The mixture is then hot pressed according to the following procedures. Initially, the mixture is placed in the mold and the mixture is heated to 190° C. A full pressure of 3 tons/in$^2$ is then applied for 15 minutes, followed by a cool down. After hot pressing, the formed abrasive undergoes a post-forming bake at 210° C. for 16 hours.

Sample C1 is formed into an abrasive wheel having essentially the same dimensions as the abrasive wheel of Sample S1. Sample C1 has approximately 28 vol % abrasive grains, 42 vol % organic bond material (phenolic resin), approximately 25 vol % of SiC grit (U.S. Mesh 800), and approximately 3-4 vol % furfural. Sample C1 is available from Norton Abrasives as a PCD resinoid grinding wheel. Sample C1 had the same dimensions as the sample S1 wheel.

Samples C1 and S1 are used to grind superabrasive workpieces (i.e., PDC cutting elements having tungsten carbide substrates and polycrystalline diamond abrasive layers) in a centerless grinding operation. The parameters of the centerless grinding operation are as follows: an abrasive wheel speed of 6500 ft/min [1981 m/min], a regulating wheel speed of 94 ft/min [29 m/min], a regulating wheel angle of 2 degrees, a depth of cut approximately 0.001 in radially (0.002 in change in diameter targeted per grind), and a through feed rate with manual assist approximately 40 in/min [101 cm/min]

Figure 3:
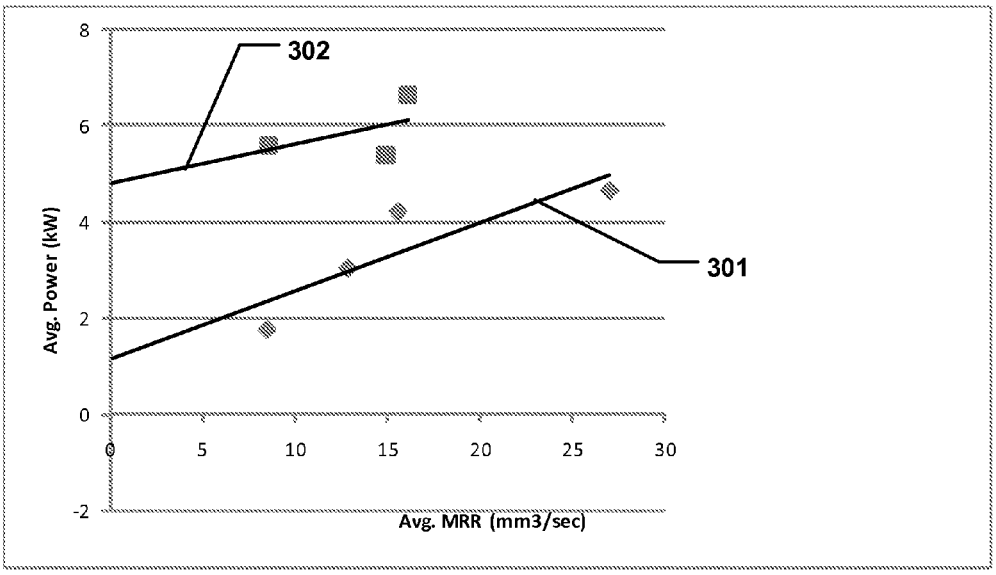
FIG. 3 includes a plot of average power (kW) versus average material removal rate (mm$^3$/sec) for a bonded abrasive body according to an embodiment and a conventional sample.

FIG. 3 includes a plot of average power (kW) versus average material removal rate ($mm^3$/sec) for the grinding operation carried out using samples S1 (plot 301) and C1 (plot 302). As clearly illustrated, sample S1 utilizes less power at all measured average material removal rates as compared to the sample C1, thus demonstrating that sample S1 was capable of conducting grinding in a more efficient manner than the sample C1. In fact, even at the highest material removal rate (27 $mm^3$/sec [1.2 $in^3$/mm]) for sample S1, the average power (approximately 4.5 kW) was about the same or less than the threshold power of sample C1 (approximately 4.8 kW), which is extrapolated based on the plot 302 crossing the y-axis of average power. Note that the threshold power can be normalized to the size of the samples based on the contact width of the wheel, such that the normalized threshold power of 4 kW/25.4 mm is equal to 150 W/mm.

Furthermore, upon evaluation of the surfaces of the bonded abrasive samples S1 and C1 after conducting centerless grinding operations on certain workpieces, it was noted that samples C1 and S1 demonstrated significantly different surface morphologies.

Figure 4:
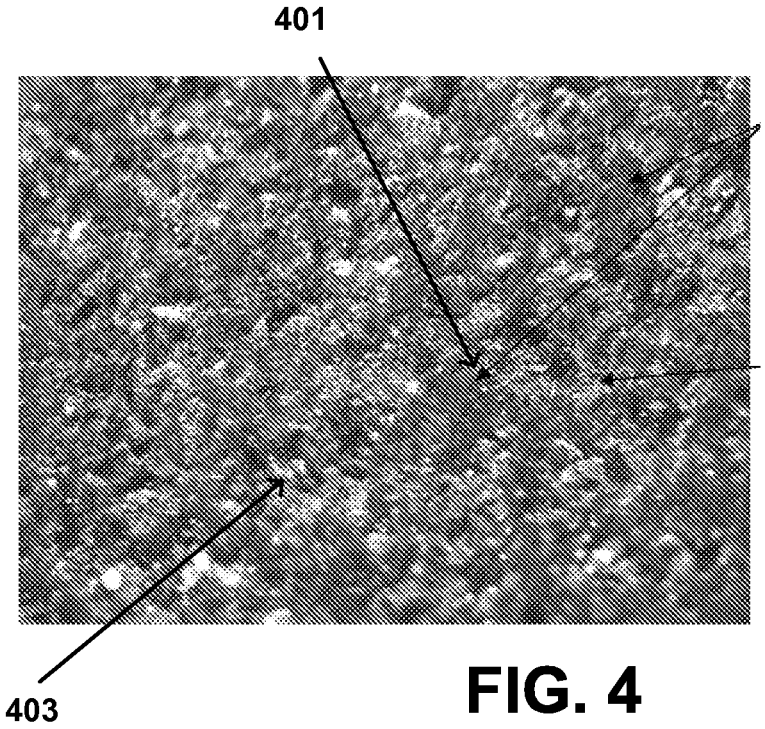
FIG. 4 includes an image of a surface of an abrasive article in accordance with an embodiment after conducting a grinding operation.
Figure 5:
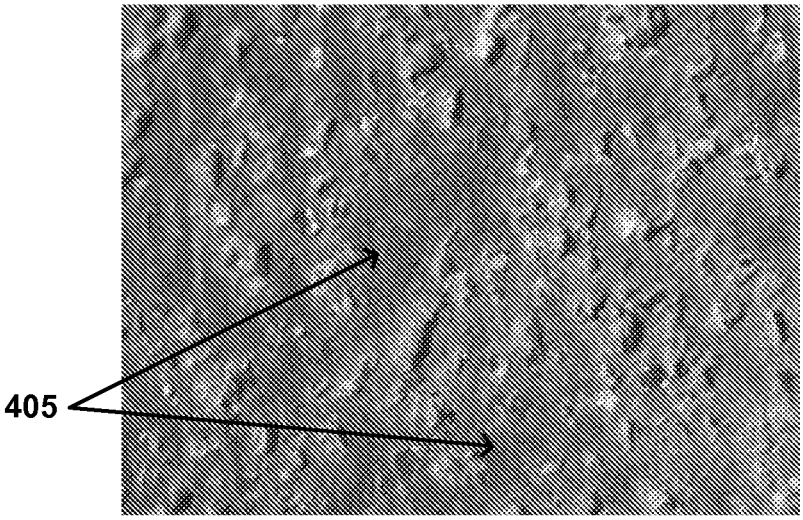
FIG. 5 includes an image of a surface of a conventional abrasive article after conducting a grinding operation.

FIGS. 4 and 5 include images of the surfaces of the samples S1 and C1 respectively after conducting grinding operations. As illustrated, the surface of sample S1 as provided in FIG. 4, demonstrates regions 401 and 403 along the surface that have maintained significant surface roughness, and therefore provides evidence that the abrasive article is capable of continued abrasive operations. Additionally, the rough regions 401 and 403 demonstrate the bonded abrasive article is capable of performing the abrasive task in an efficient manner and has improved life. By contrast, the surface of the sample C1, as shown in FIG. 5, demonstrates regions 501 of the bond that have smeared and have become smooth. These regions 501 demonstrate a bond that has a high amount of friction with the workpiece, which is evidence of an inefficient grinding operation as compared to the sample S1. In short, sample S1 is capable of achieving greater efficiency during grinding of super-hard workpieces than the conventional sample C1.

The foregoing bonded abrasive articles of embodiments herein and methods of forming and using such bonded abrasive articles represent a departure from the state-of-the-art. In particular, the bonded abrasive bodies utilize a combination of features including a mixture of abrasive grains, abrasive grain types and sizes, composite bond material having particular ratios of metal and organic materials, and certain properties that improve the efficiency of grinding operations on super-hard and/or superabrasive workpieces. Moreover, the methods described herein, including the method of making the bonded abrasive and the method of using the bonded abrasive for particular grinding operations represent a departure from the state of the art. It is noted that use of bonded abrasive articles according to the embodiments herein in certain grinding operations allows for more efficient grinding and extended life of the bonded abrasive article.

In the foregoing, reference to specific embodiments and the connections of certain components is illustrative. It will be appreciated that reference to components as being coupled or connected is intended to disclose either direct connection between said components or indirect connection through one or more intervening components to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The disclosure will not be used to interpret or limit the scope or meaning of the claims. In addition, in the foregoing description includes various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments.

What is claimed is:

1. An abrasive article comprising:

a bonded abrasive having a body including abrasive grains contained within a bond material comprising an organic material and a metal material, wherein between 82% to 97% of the abrasive grains are contained within the metal material of the bond material, and wherein the body is capable of grinding a superabrasive workpiece having an average Vickers hardness of at least about 5 GPa at an average specific grinding energy (SGE) of not greater than about 350 J/$mm^3$ at an average material removal (MRR) rate of at least about 8 $mm^3$/sec for a centerless grinding operation.

2. The abrasive article of claim 1, wherein the body comprises a threshold power for grinding of not greater than about 150 W/mm during centerless grinding of the superabrasive workpiece.

3. The abrasive article of claim 1, wherein the body achieves an average material removal rate (MRR) of at least about 10 $mm^3$/sec.

4. The abrasive article of claim 1, wherein the average Vickers hardness of the workpiece is at least about 10 GPa.

5. The abrasive article of claim 1, wherein the workpiece is a composite material comprising a substrate and an abrasive layer overlying the substrate.

6. The abrasive article of claim 1, wherein the workpiece comprises a polycrystalline diamond compact (PDC) cutting element.

7. The abrasive article of claim 5, wherein the substrate comprises a metal having a Mohs hardness of at least about 8.

8. The abrasive article of claim 5, wherein the substrate comprises a metal element comprising a transition metal material.

9. The abrasive article of claim 1, wherein the workpiece is in the shape of cylindrical body.

10. An abrasive article comprising:

a bonded abrasive having a body including abrasive grains contained within a composite bond material comprising an organic material and a metal material, wherein the composite bond material comprises a ratio (OM/MM) of organic material by volume (OM) to metal material by volume (MM) of not greater than about 0.25, and wherein between 82% to 97% of the abrasive grains are contained within the metal material of the bond material.

11. The abrasive article of claim 10, wherein the organic material comprises a material selected from the group of materials consisting of polyimides, polyamides, epoxies, resins, aramids, polyesters, polyurethanes, and a combination thereof.

12. The abrasive article of claim 10, wherein the organic material comprises not greater than about 20 vol % of the total volume of the bond material.

13. The abrasive article of claim 10, wherein the metal material comprises a metal alloy.

14. The abrasive article of claim 13, wherein the metal material comprises a transition metal element.

15. The abrasive article of claim 14, wherein the metal material comprises copper and tin.

16. The abrasive article of claim 10, wherein the metal material comprises at least about 20 vol % of the total volume of the bond material.

17. The abrasive article of claim 10, wherein the body comprises a porosity of not greater than about 10 vol % of the total volume of the body.

18. An abrasive article comprising:

a bonded abrasive having a body configured to grind workpieces comprising superabrasive material, wherein the body comprises abrasive grains contained within a composite bond material including an organic material and a metal material, wherein between about 85% and about 97% of the abrasive grains by volume are contained within the metal material of the composite bond material.

19. The abrasive article of claim 18, wherein the workpiece comprises a fracture toughness of at least about 4.0 MPa $m^{0.5}$.

20. The abrasive article of claim 18, wherein the workpiece comprises a fracture toughness of not greater than about 16.0 MPa $m^{0.5}$.

* * * * *